US008776420B2

(12) United States Patent
Langevin et al.

(10) Patent No.: US 8,776,420 B2
(45) **Date of Patent: *Jul. 15, 2014**

(54) FIREARM HAVING A REMOVABLE HAND GUARD

(71) Applicants: Kevin Langevin, Berlin, CT (US); Paul Hochstrate, Plantsville, CT (US); Grzegorz Kuczynko, Unionville, CT (US)

(72) Inventors: Kevin Langevin, Berlin, CT (US); Paul Hochstrate, Plantsville, CT (US); Grzegorz Kuczynko, Unionville, CT (US)

(73) Assignee: Colt's Manufacturing Company LLC, West Hartford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/723,583

(22) Filed: Dec. 21, 2012

(65) Prior Publication Data

US 2013/0205634 A1 Aug. 15, 2013

Related U.S. Application Data

(63) Continuation of application No. 12/100,268, filed on Apr. 9, 2008, now Pat. No. 8,336,243.

(51) Int. Cl.
*F41C 23/16* (2006.01)

(52) U.S. Cl.
USPC ..... 42/71.01

(58) Field of Classification Search
USPC ..... 42/71.01, 72
See application file for complete search history.

(56) References Cited

U.S. PATENT DOCUMENTS

| | | | | |
|---|---|---|---|---|
| 4,663,875 | A | 5/1987 | Tatro | |
| 5,590,484 | A | 1/1997 | Mooney et al. | |
| 5,826,363 | A | 10/1998 | Olson | |
| 6,401,379 | B1 * | 6/2002 | Moon | 42/71.02 |
| 6,490,822 | B1 | 12/2002 | Swan | |
| 6,508,027 | B1 | 1/2003 | Kim | |
| 6,609,321 | B2 | 8/2003 | Faifer | |
| 6,671,990 | B1 | 1/2004 | Booth | |
| 6,779,288 | B1 * | 8/2004 | Kim | 42/72 |
| 6,836,990 | B2 | 1/2005 | Shiloni | |
| 6,895,708 | B2 | 5/2005 | Kim et al. | |
| 7,059,076 | B2 | 6/2006 | Stoner et al. | |
| 7,131,228 | B2 | 11/2006 | Hochstrate et al. | |
| RE39,465 | E | 1/2007 | Swan | |
| 7,216,450 | B2 * | 5/2007 | Pikielny | 42/71.01 |
| 7,231,861 | B1 | 6/2007 | Gauny et al. | |

(Continued)

FOREIGN PATENT DOCUMENTS

WO 2009082520 A2 7/2009

OTHER PUBLICATIONS

Jeff W. Zimba, The Hydra Modular Weapons System from MGI, The Small Arms Review, vol. 10, No. 8—May 2007.

*Primary Examiner* — Bret Hayes
(74) *Attorney, Agent, or Firm* — Cantor Colburn LLP

(57) ABSTRACT

A method of making a hand guard for a semi-automatic or automatic rifle is provided. The method including the steps of: forming a first portion of the hand guard from a first material; inserting the formed first portion into a mold; and molding a second portion of the hand guard about the first portion, the second portion being a second material, the second material being different from the first material, wherein a first section of the first portion is completely encased by the second portion and a second section of the first portion is not encased by the second portion.

19 Claims, 10 Drawing Sheets

(56) References Cited

U.S. PATENT DOCUMENTS

| | | | | |
|---|---|---|---|---|
| RE40,216 | E | 4/2008 | Swan | |
| 7,363,741 | B2 | 4/2008 | DeSomma et al. | |
| 7,523,580 | B1 | 4/2009 | Tankersley | |
| 7,584,567 | B1 | 9/2009 | DeSomma et al. | |
| 7,716,865 | B2 | 5/2010 | Daniel et al. | |
| 8,336,243 | B2 * | 12/2012 | Langevin et al. | 42/71.01 |
| 2003/0106251 | A1 | 6/2003 | Kim | |
| 2004/0003529 | A1 | 1/2004 | Danielson | |
| 2004/0144010 | A1 | 7/2004 | Golan | |
| 2005/0011101 | A1 | 1/2005 | Gooder | |
| 2005/0262752 | A1 | 12/2005 | Robinson et al. | |
| 2006/0026883 | A1 | 2/2006 | Hochstrate et al. | |
| 2007/0006509 | A1 | 1/2007 | DeSomma et al. | |
| 2007/0033851 | A1 | 2/2007 | Hochstrate et al. | |
| 2007/0199224 | A1 | 8/2007 | Bentley | |
| 2007/0199435 | A1 | 8/2007 | Hochstrate et al. | |
| 2009/0038198 | A1 | 2/2009 | Yu | |
| 2010/0126054 | A1 | 5/2010 | Daniel et al. | |
| 2010/0175293 | A1 | 7/2010 | Hines | |
| 2010/0186278 | A1 | 7/2010 | Daniel | |

* cited by examiner

FIREARM HAVING A REMOVABLE HAND GUARD

CROSS REFERENCE TO RELATED APPLICATIONS

This application is a continuation of U.S. patent application Ser. No. 12/100,268 filed Apr. 9, 2008, now U.S. Pat. No. 8,336,243 B2, the contents of which are incorporated herein by reference thereto.

This application is also related to U.S. application No. 60/849,957, filed Oct. 6, 2006, U.S. application Ser. No. 11/869,676, filed Oct. 9, 2007, U.S. application No. 60/772,494, filed Feb. 9, 2006, U.S. application Ser. No. 11/231,063, filed Sep. 19, 2005, U.S. application Ser. No. 11/339,187, filed Jan. 25, 2006 and U.S. application Ser. No. 11/352,036, filed Feb. 9, 2006 all of which are incorporated by reference herein in their entirety.

BACKGROUND

1. Field

The disclosed embodiments relate to a firearm and, more particularly, to a firearm having a removable hand guard.

2. Brief Description of Earlier Developments

There are firearms having a single conventional hand guard configuration that is inflexible in terms of the accessory mounting rail options. This is not desirable in operational conditions where different operational scenarios may generate a desire for different accessories to be mounted. There are conventional firearms with an integral upper receiver and hand guard. The conventional firearms have a removable hand guard section connected to the hand guard on the upper receiver with fasteners. Removal of the conventional hand guard section hence involves removal tools, and once removed the fasteners may be lost. This is not desirable in operational conditions.

SUMMARY

In accordance with one exemplary embodiment, a semi-automatic or automatic rifle is provided. The rifle comprises a receiver having a receiver frame, a barrel removably connected to the receiver frame, and an end cap coupled to the barrel. A removable hand guard section is provided extending over and generally surrounding the barrel, the removable hand guard section removably connected to the receiver. The removable hand guard section has a locating feature adapted to engage with the end cap and locate the hand guard relative to the end cap. The removable hand guard section has a mounting rail portion and a body portion, the mounting rail portion molded into the body portion. The barrel has a locking collar adapted to removably position and lock the removable hand guard section relative to the receiver frame and the barrel. The removable hand guard floats in position relative to the barrel.

In accordance with another exemplary embodiment, a semi-automatic or automatic rifle having a black rifle configuration is provided. The rifle having a receiver having a receiver frame and a barrel removably connected to the receiver frame. The receiver extending over and generally surrounding the barrel. The receiver having a removable hand guard section removably connected to the receiver. The removable hand guard section having a molded composite structure having a mounting rail portion and a non-metallic body portion, the mounting rail portion molded into the body portion. The removable hand guard section is modular and interchangeable with other hand guards and rails.

In accordance with another exemplary embodiment, a rifle hand guard kit for a rifle having a black rifle configuration is provided. The hand guard retrofit kit has a removable hand guard section adapted to extend over and generally surround a barrel of the rifle, the removable hand guard section removably connectable to a receiver of the rifle. The removable hand guard section having a locating feature adapted to engage with a capture of the rifle and locate the hand guard relative to the capture. The removable hand guard section having a molded composite structure having a mounting rail portion and a non-metallic body portion, the mounting rail portion molded into the body portion. The removable hand guard section is modular and interchangeable with other hand guards that are different than the hand guard section.

In another embodiment, a method of making a hand guard for a semi-automatic or automatic rifle is provided, the method including the steps of: forming a first portion of the hand guard from a first material; inserting the formed first portion into a mold; and molding a second portion of the hand guard about the first portion, the second portion being a second material, the second material being different from the first material, wherein a first section of the first portion is completely encased by the second portion and a second section of the first portion is not encased by the second portion.

In yet another embodiment, a method of providing a removable hand guard for a rifle is disclosed. The method including the steps of: providing an upper receiver of a rifle; removably securing the hand guard to the receiver, wherein the hand guard is formed by: forming a first portion of the hand guard from a first material; inserting the formed first portion into a mold; and molding a second portion of the hand guard about the first portion, the second portion being a second material, the second material being different from the first material, wherein a first section of the first portion is completely encased by the second portion and a second section of the first portion is not encased by the second portion.

BRIEF DESCRIPTION OF THE DRAWINGS

The foregoing aspects and other features of the exemplary embodiments are explained in the following description, taken in connection with the accompanying drawings, wherein.

DETAILED DESCRIPTION OF THE EXEMPLARY EMBODIMENT(S)

Figure 1:
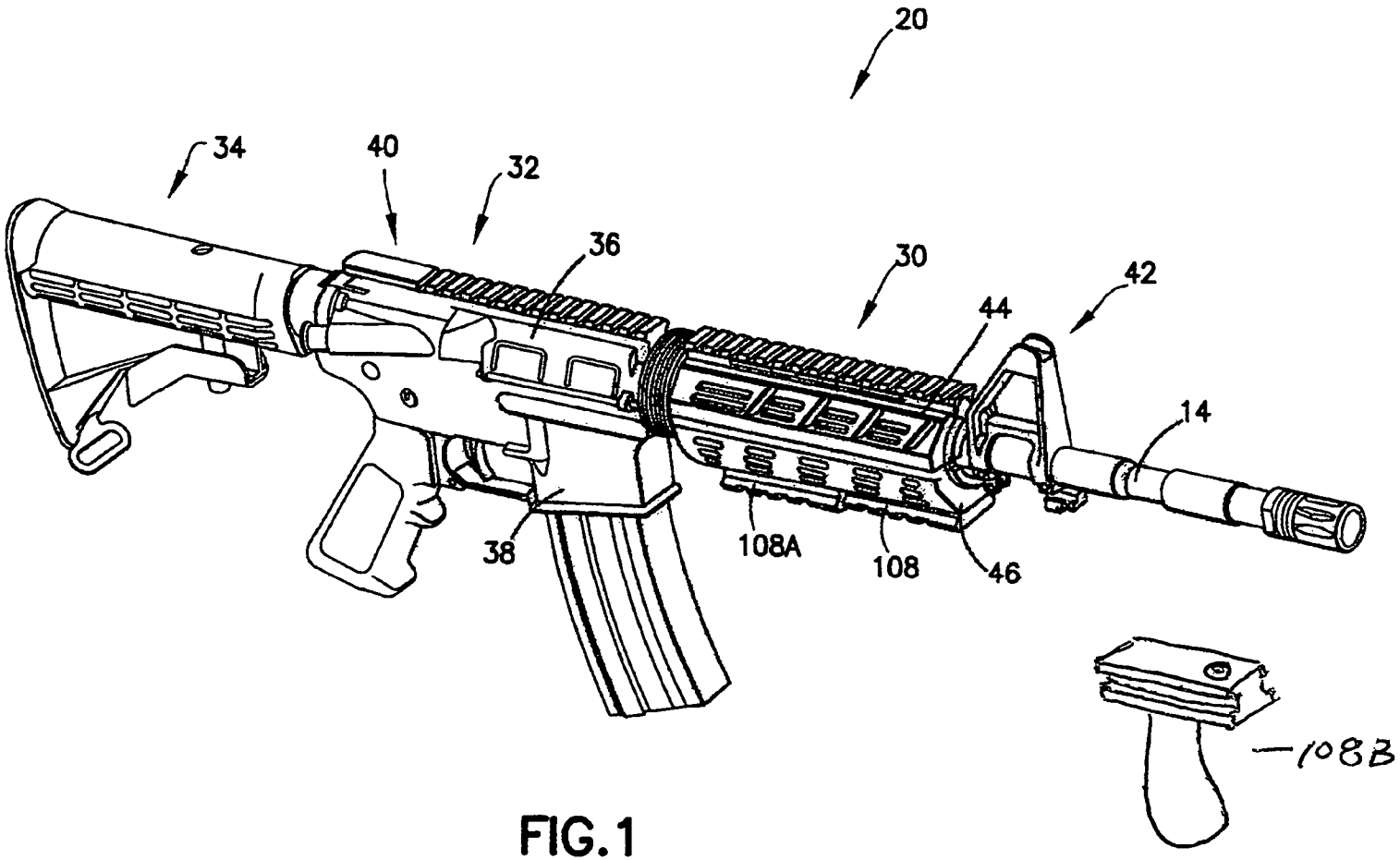
FIG. 1 is an isometric view of an automatic firearm incorporating features in accordance with an exemplary embodiment.

Referring to FIG. 1, there is shown, an isometric view an automatic or semi-automatic firearm 20 capable of automatic or semiautomatic fire incorporating features in accordance with an exemplary embodiment. Although the present invention will be described with reference to the embodiments shown in the drawings, it should be understood that the present invention can be embodied in many alternate forms of embodiments. In addition, any suitable size, shape or type of elements or materials could be used.

Firearm 20 is illustrated as generally having what is known generally as a "black rifle" configuration. The black rifle configuration being the family of rifles developed by Eugene Stoner, for example, such as an M4™ (available from Colt Defense, LLC) or M16 type automatic firearm configuration. However, the features of the disclosed embodiments, as will be described below, are equally applicable to any desired type of automatic or semiautomatic firearm. Firearm 20 may have operational features such as disclosed in U.S. Pat. Nos. 5,726,377, 5,760,328, 4,658,702 and 4,433,610, and patent application Ser. No. 60/564,895 filed Apr. 23, 2004; Ser. No. 10/836,443 filed Apr. 30, 2004, Ser. No. 60/849,957 filed Oct. 6, 2006, Ser. No. 60/772,494 filed Feb. 9, 2006, Ser. No. 11/231,063 filed Sep. 19, 2005, Ser. No. 11/339,187, filed Jan. 25, 2006 and Ser. No. 11/352,036, filed Feb. 9, 2006 all of which are hereby incorporated by reference herein in their entirety. The firearm 20 and its sections described in greater detail below is merely exemplary, and in alternate embodiments the firearm 20 may have other sections, portions or systems. Firearm 20 may incorporate a hand guard 30 having upper hand guard 44 and lower hand guard 46, a receiver section 32 having upper receiver 36 and lower receiver 38, a barrel 14, stock 34, rear sight 40 and front sight 42. Hand guard 30 may further incorporate vent holes, ribbing, heat shields or double heat shields and liners to facilitate cooling of the barrel 14 while keeping hand guard 30 at a temperature sufficient for an operator to hold the hand guard. Hand guard 30 may have features such as disclosed in U.S. Pat. Nos. 4,663,875 and 4,536,982, both of which are hereby incorporated by reference herein in their entirety. Hand guard 30 may have a shell having vent holes and external ribbing. Hand guard 30 may be ergonomically sized to allow a user to comfortably grip the guard. In alternate embodiments, multiple shells, inner ribbing, heat shields or double heat shields and liners to facilitate cooling of the barrel 14 while keeping hand guard 30 at a temperature sufficiently low for an operator could be provided. In alternate embodiments, removable and relocatable rails may be provided on hand guard 30 and may be permanently mounted or removably mounted and be removable or moveable to different locations on hand guard 30. The rails and mounting system to the hand guard may be substantially similar to rails described in U.S. patent application Ser. No. 11/113,525 filed Apr. 25, 2005, which is incorporated by reference herein in its entirety. In alternate embodiments, rails may be in different locations with different sizes. Hand guard 30 and receiver section 32 may be configured to support such rails as a "Piccatiny Rail" configuration as described in Military Standard 1913, which is hereby incorporated by reference herein in its entirety. The rails may be made from any suitable material such as hard coat anodized aluminum as an example. Front sight assembly 42 is shown mounted to barrel 14. Front sight 42 may comprise a gas block having an integral sight, for example is as disclosed in U.S. application Ser. No. 11/352,036 and/or U.S. application No. 60/772,494 and/or U.S. application Ser. No. 11/231,063 all of which are incorporated by reference herein in their entirety. In alternate embodiments, front sight assembly 42 may be removable, allowing alternate mounting of desired accessory in its place such as a telescopic sight or laser sight. Rear sight assembly 40 is provided and mounted to receiver section 32. Rear sight assembly 40 may incorporate a sight ring and sight adjustment knobs provided to adjust the position of sight ring relative to the barrel 14 and front sight 42 for accurate target sighting.

Figure 2:
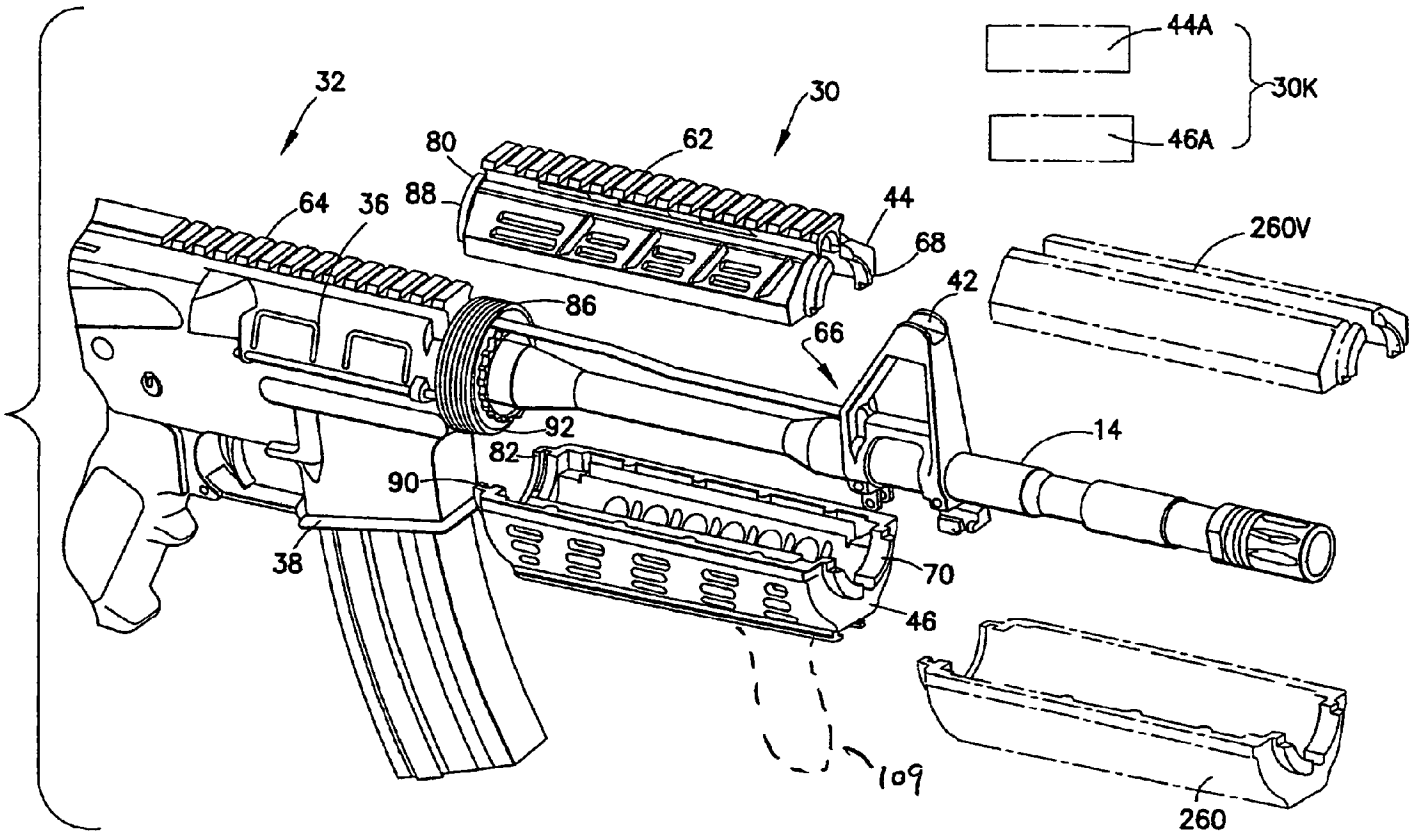
FIG. 2 is an exploded isometric view of the automatic firearm shown in FIG. 1.

Referring now to FIG. 2, there is shown an exploded isometric view of the automatic or semiautomatic firearm 30 shown in FIG. 1. As noted before, the auto or semiautomatic rifle may incorporate one or more features as described in U.S. application No. 60/849,957, filed Oct. 6, 2006, U.S. application No. 60/772,494, filed Feb. 9, 2006, U.S. application Ser. No. 11/231,063, filed Sep. 19, 2005, U.S. application Ser. No. 11/339,187, filed Jan. 25, 2006 and U.S. application Ser. No. 11/352,036, filed Feb. 9, 2006, all of which are hereby incorporated by reference in their entirety. For example, though illustrated (see FIG. 2) with a direct gas operating system (for example only) the firearm may incorporate a gas piston system (not shown) generally similar to embodiments in U.S. application Ser. No. 11/231,063 and 60/849,957 hereby incorporated by reference in their entirety. As a further example, the rifle may include a rear regulator, for example as shown U.S. application Ser. No. 11/339,187 hereby incorporated by reference in its entirety. The firearm may be provided with over the beach capability allowing immediate firing of the weapon after water submersion regardless of weapon orientation. In alternate embodiments, a folding stock may be provided increasing weapon versatility by reducing the overall length to shoulder width. A folding stock further may enhance weapon balance for stability and to retain a target during firing. Greaseless fire control system parts may be provided. For example, the fire control system parts may be coated with a coating, such as UCTD UltraCem R coating to eliminate the need for lubrication and to reduce the accumulation of foreign material and residue and to provide ease in cleaning.

In the embodiment shown, forward extending hand guard/rail system 30 is provided. Hand guard 30 is shown removable but in the exemplary embodiment, may compare in function and alignment, if desired, to a one-piece upper receiver extended rail system due to for example a hand guard stabilization features as will be described further below. In the exemplary embodiment, the hand guard system 30 may be arranged so that an accessory rail 62 of the hand guard may be aligned with accessory rail(s) fixed to the receiver. Moreover, the hand guard system 30 may retain the highly desired thermal isolating properties (such as may be available from some conventional hand guards) with proper convective flow for barrel cooling, while providing the ability to mount accessories to the hand guard, via Piccatiny rails, (as with metal hand guards) without discomfort from barrel heating. Further, the hand guards system 30 comprises hand guard sections that are fully interchangeable with each other and with other different hand guard sections 260 including conventional hand guards.

In the embodiment shown, the rail system/hand guard 30 is coupled to the upper receiver 36 so that the rail system hand guard is capable of movement relative to the upper receiver and may float with the barrel 14 to increase accuracy and optimize axis rail mounting options for accessory tailoring and operator handling comfort. The guard is shown as a split guard having upper 44 and lower 46 sections that may be removable. In alternate embodiments, the guard may include fewer or more sections (e.g. the hand guard may have, three four or more guard sections extending along the barrel generally similar to the upper and lower hand guards). Heat shields may be provided similar to U.S. application Ser. No. 11/352,036, hereby incorporated by reference in its entirety. The heat removal bleeding system protects the operator from barrel heat, increases sustained rate of fire and extends the barrel life. The upper hand guard 44 is shown in the exemplary embodiment, unitary with integral upper rail 62. In the exemplary embodiment, the upper rail 62 may be aligned with the rail 64 integrally formed on the upper receiver 36 and extends in front of upper rail 64 when upper hand guard 44 is mounted. Cap 66 is provided on barrel 14 and interfaces with the front 68, 70 of the removable hand guard sections 44, 46. The guards 44, 46 and the cap 66 may for example have complementing conical tapered radially locating features 68, 70 that fix the hand guards, eliminating play in the guard mount relative to the cap 66. In alternate embodiments, the guard mounting to the cap and barrel could have any other radially locating and/or fixing features engaged by longitudinal displacement of the guard. In alternate embodiments, the upper 44 and lower 46 guards and cap 66 may also have other interlocking facets, for example, a pin and hole system for rotational positioning may be provided. In alternate embodiments, other surfaces, for example, conical surfaces may be provided for radial fixing and/or may be added to pins and holes to simultaneously locate and lock the hand guards in position both in axial, radial and rotational directions. The rear portions 80, 82 of the hand guards are removably attached to the receiver 36. In the embodiment shown, attachment of the upper 44 and lower 46 hand guards to the receiver 36 may be generally similar to that of conventional hand guards. Though in alternate embodiments the rear fit between hand guard sections and receiver may utilize a tapered radial interlocking rabbett fit between a barrel nut collar and a V-groove at the rear 80, 82 of the guards 44, 46. For example, the v-groove at the rear of the guard may interface with the barrel nut assembly to removably lock the guards radially in place. In the exemplary embodiment, a wave or spring washer may be positioned within hand guard sections that biases the guard sections 44, 46 towards cap 66 locking the hand guards in place similar to conventional hand guard sections. In alternate embodiments, other suitable actuator, locking device or detent could be provided. Hand guard section 44, 46 may be snapped into installed position in a manner similar to conventional sections by compressing the spring washer and positioning the section to engage cap 66. In the embodiment shown, the hand guard 44, 46 floats with the barrel 14 with the upper rail 62 of the upper hand guard 44 substantially collinear with receiver rail 64. If desired, colinearity may be maintained for example by having the hand guard portion positioned and substantially fixed to the receiver rail with a bridge clamp on a mount (not shown) that engages the front portion of the receiver rail to the end portion of the hand guard rail.

Figure 3:
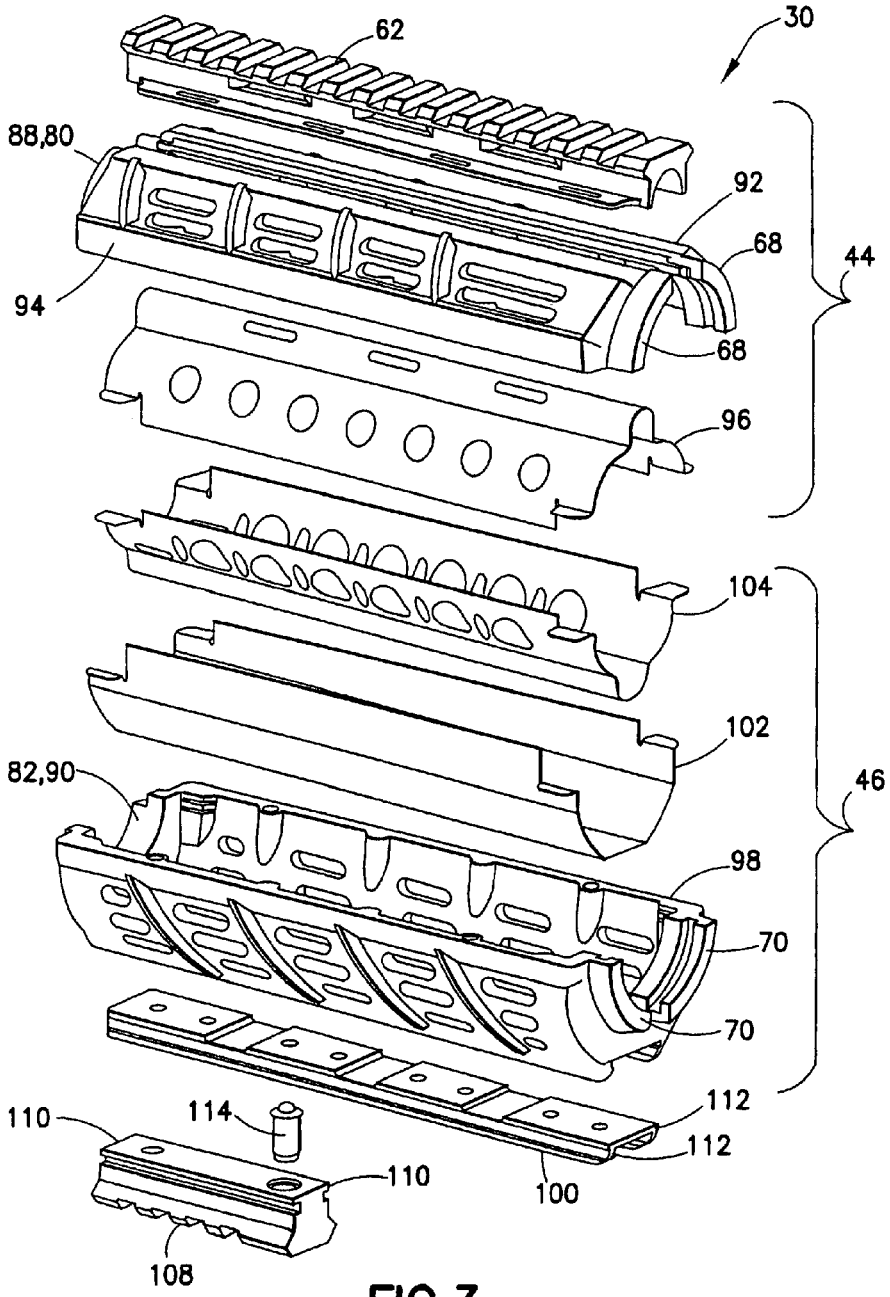
FIG. 3 is an exploded isometric view of the upper and lower hand guards of the firearm shown in FIG. 1.

Referring now to FIG. 3, there is shown an exploded isometric view of the upper and lower hand guards of the firearm shown in FIG. 1. Generally, hand guard 30 has non metal hand guard body portion with integral rails. Hand guard 30 is fully modular in that hand guard 30 is freely interchangeable with each other (e.g. upper/lower) and with other different hand guards including for example conventional hand guards for the black rifle (e.g. M4™) with or without accessory rails. For example, lower hand guard 46 may be used with a different upper hand guard 260U (see FIG. 2) such as for example a conventional upper hand guard for a black rifle (e.g. M4™). Similarly, upper hand guard 44 may be used with a different lower hand guard 260. Here, hand guards 44, 46 may be completely interchangeable with other hand guard sections 260, 260U and completely and freely interchangeable upper and lower sections with each other. Hand guards 44A, 46A (substantially similar to hand guard sections 44, 46) may be configured, for example, as a kit 30K with full modularity (for example freely and completely interchangeable with themselves and other different hand guard sections) and may for example have an interface between sections similar as a conventional hand guard for the black rifle (e.g. M4™). In alternate embodiments, the hand guards may be retrofittable for any suitable firearm, for example, for an M16 type firearm or otherwise. Hence, any suitable interchangeable guard portion 260, 260U may be interchanged with guard portions 44, 46 as shown in FIG. 2. For example, the modularity allows the mounting of portions of conventional and hand guards 44, 46 with each other in any desired combination. For example, an old top hand guard may be used with a new bottom hand guard or vice versa.

Figure 4:
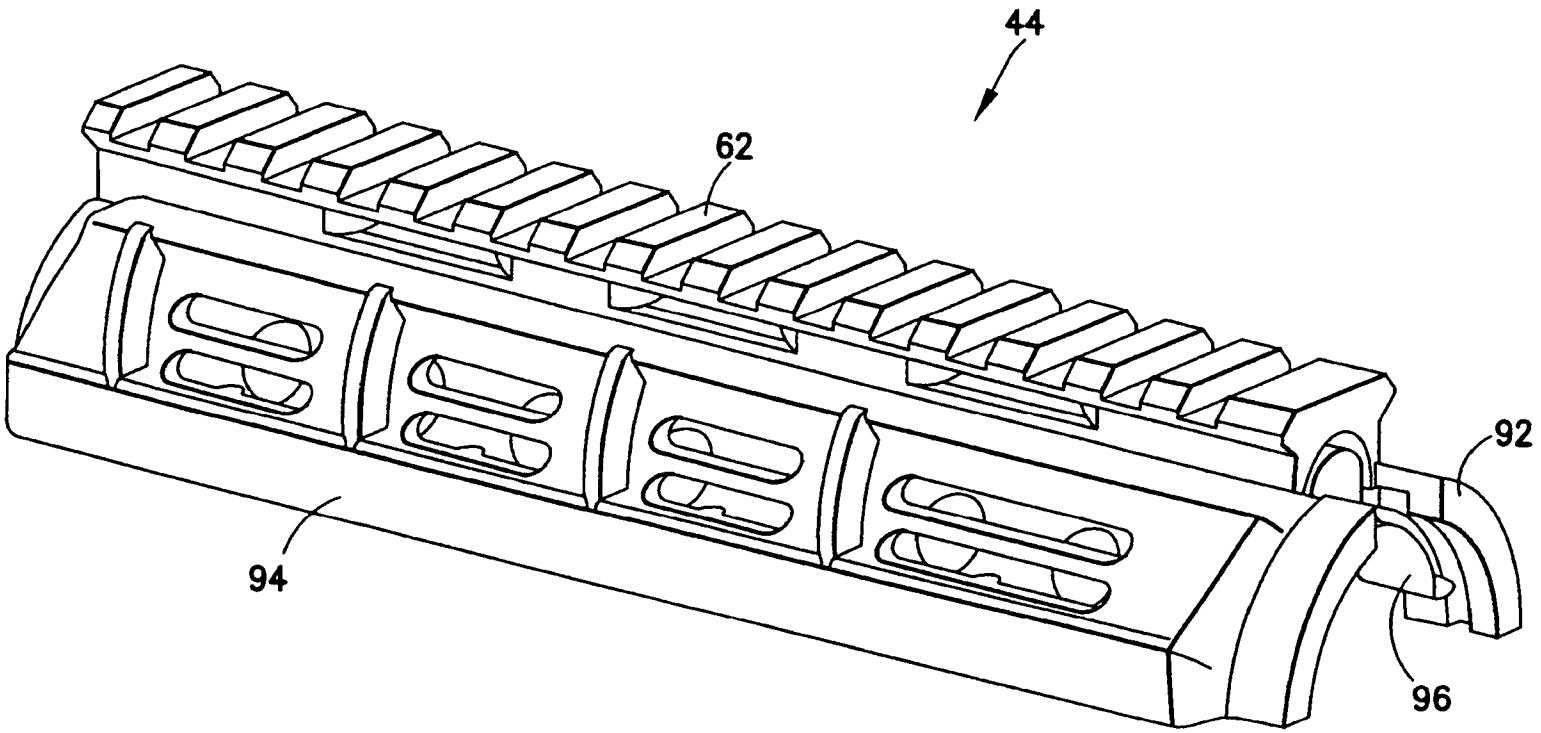
FIG. 4 is an isometric view of an upper hand guard.
Figure 5:
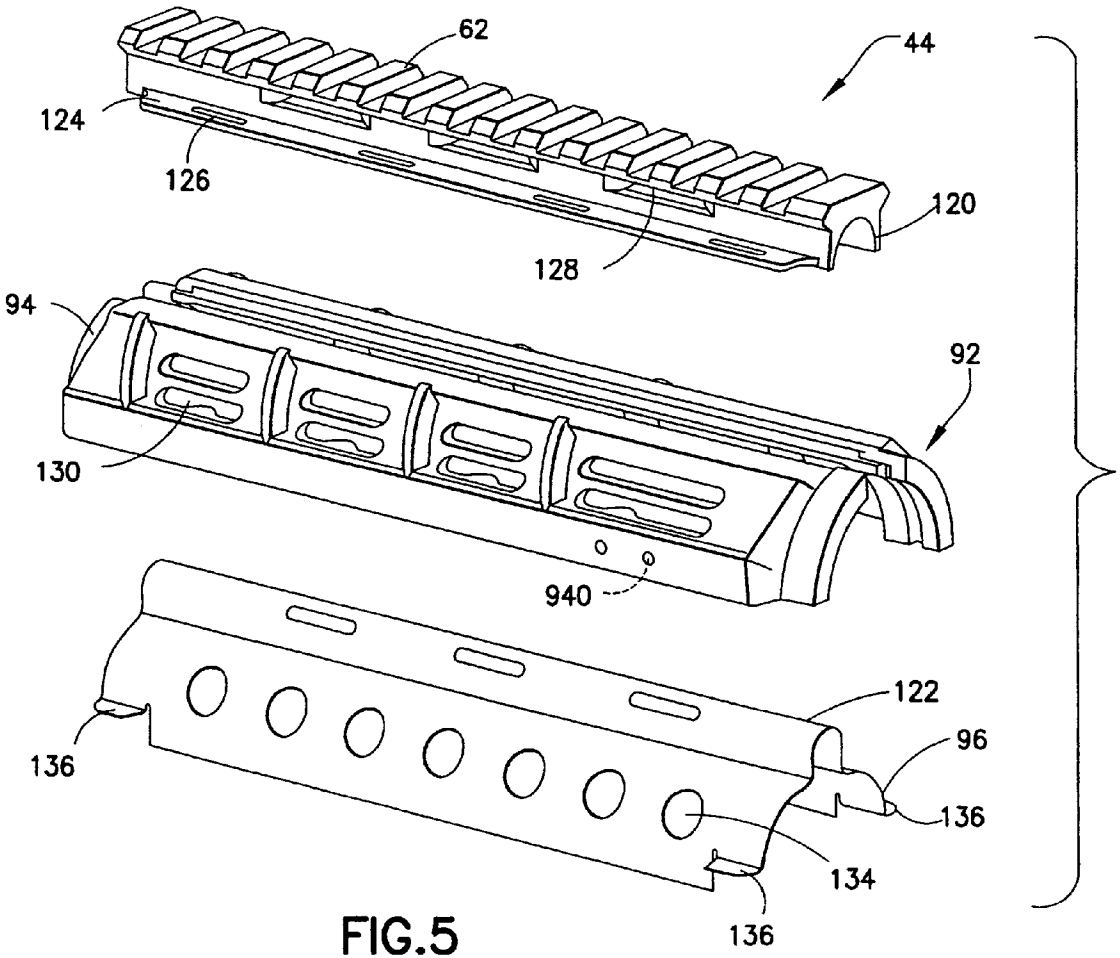
FIG. 5 is an exploded isometric view of an upper hand guard.

In the exemplary embodiment, upper hand guard 44 has body portion 92, 94, rail portion 62 and shield portion 96. As will be described, rail portion 62 is molded into body portion making rail portion 62 and body portion 92, 94 of unitary construction. Shield portion 96 may be removably snapped into the unitary assembly of rail portion 62 and body portion 92, 94 to allow removal such as for cleaning. Body portions 92, 94 may be made for example of non-metallic, thermal isolating material such as plastic or desired polymer rail portion may be made of metal such as aluminum. In the exemplary embodiment, lower hand guard 46 generally may have body portion 98, attachment or T-rail portion 100 and shield portion 102, 104. As will be described, T-rail portion 100 may be molded into body portion 98 making T-rail portion 100 and body portion 98 of unitary construction. Shield portion 102, 104 may be removably snapped into the unitary assembly of T-rail portion 100 and body portion 98 to allow removal such as for cleaning. Body portion 98 may be made of desired polymer, and mounting rail 100 may be made of metal or any suitable material allowing fastening as described below. In alternate embodiments, any suitable combination of fastening techniques may be provided with any of the subcomponents, for example, by conventional fasteners molded into the body portions or otherwise. In alternate embodiments, any suitable combinations of rails, shields or accessories may be provided in any suitable combination. For example, a pistol grip may be integrally molded into as part of lower hand guard 46. Mounting rail 100 may be embedded and molded in the lower portion of body 98 or alternately could be located anywhere. Here, T-rail 100 may be embedded into polymer section 98 for mounting an accessory rail 108 that has a complementing T-portion 110 that engages and slides on to a mating portion 112 of T-rail 100. In the exemplary embodiment, accessory rail may comprise a Piccatiny rail or other suitable rail or accessory (e.g. pistol grip) or accessory mount. In the exemplary embodiment one or more accessory rail(s) 108, 108A (see FIG. 1) may be slid forward or rearward to stop location for mounting a desired accessory in a desired location. Accessory rail(s) 108, 108A and mounting rail 100 each may have spring loaded detent 114 that engages a mating recess (for example serially located longitudinally along rail 100) for easy location when sliding forward in order to adjust position of accessory rail 108. The position may be selectable from multiple longitudinal positions between accessory and mounting rails whereby the location of the accessory mounting rail is selectable. A set screw or other suitable locking device may further be provided. As seen in FIG. 1, the mounting rail 200 allows any desired combination of selectable accessory rail(s) 108, 108A and or accessories of different characteristic to be selectably mounted to the hand guard section. In the example shown, rails 108, 108A may be piccatiny rails of differing rail mount heights. Rail portions 62, 100 may be made from any suitable material, for example aluminum. Shield portions 96, 102, 104 may be made from any suitable material, for example, stainless steel. Hand guard body portions 92, 94, 98 may be made from any suitable material, for example, from a suitable polymer such as peek molded with the integral rails and capable of withstanding temperatures, for example about 500° F. or otherwise. Referring now to FIG. 4, there is shown an isometric view of an upper hand guard. Referring also to FIG. 5, there is shown an exploded isometric view of an upper hand guard. Top hand guard section has rail portion 62 made from aluminum or any suitable material. Rail portion 62 may be directly embedded into the polymer used to mold body portions, where rail portion 62 is placed into the mold when forming the hand guard 44. Extensions 124 having binding features such as slots 126 may be provided on rail 62 to allow sufficient structural integrity of the molded assembly. Rail 62 operates to splice polymer sections 92 and 94 together. Vents 128, 130 134 may be provided to facilitate cooling. Heat shield 96 has tabs 136 that engage mating slots in body portion 92, 94 allowing for easy removal of the shield. In the embodiment shown, rail portion 62 is mounted on top and has a cutout 120 that accommodates protrusion 122 of heat shield 96. This allows the operating rod of a piston operating system to be accommodated when the hand guard is installed. Here hand guard 44 may be used either in firearms having indirect or direct gas operating systems. Here, in the case of an operating rod system the heat shield is contoured as shown providing a channel through which the operating rod extends. Similarly, the rail is formed to provide a tunnel for the operating rod of a gas piston operating system. In the embodiment shown, rail splice 120 is shaped to accommodate the operating rod tunnel. In alternate embodiments splice polymer sections may be mounted to the rail by any other suitable manner. Here, hand guard section 44 comprises two polymer pieces 92, 94 that are similar but opposed bridged by accessory rail 62 that forms the top splice allowing for a lower profile upper guard with the top surface of accessory rail 62 to be substantially the same as top of the upper receiver rail. Here, the polymer sections 92, 94 are molded onto an "back bone" 62 that may be of metal such as aluminum or other suitable metal or may be non-metal (e.g. ceramic, composite) and ties polymer sections 92, 94 together. Insert holes 940 (holes in section 94 shown, holes in section 92 similar) may be molded into the guard, for example at 3 and 9 clock positions for additional side rails of any suitable length or combination. Here, an insert may be placed into holes, for example, molded into, glued, ultrasonic welded or otherwise bonded by any suitable method. The insert may be made from stainless steel or other suitable metal or nonmetal. In the case of no insert, the surface of the hole may be closed with polymer.

Figure 6:
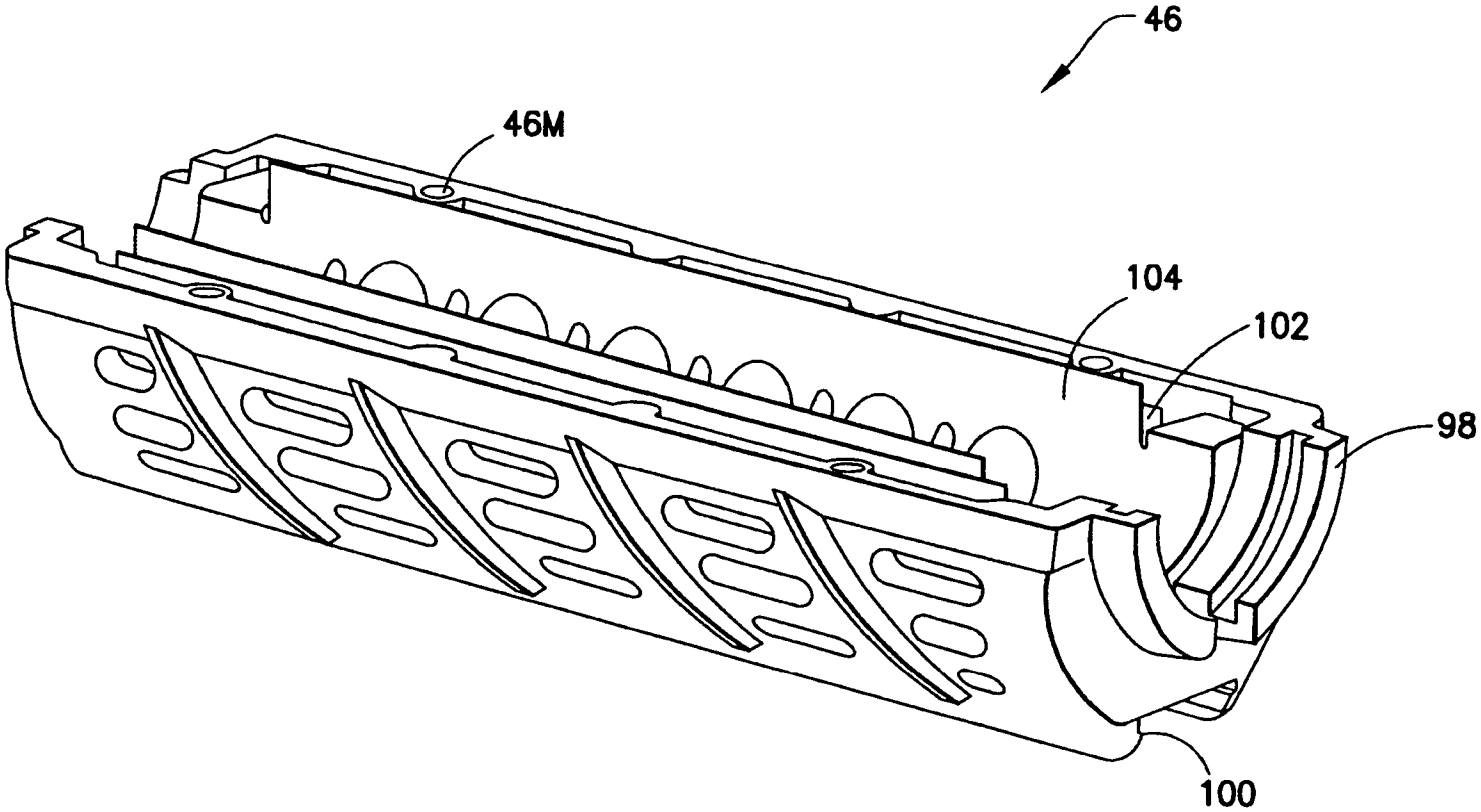
FIG. 6 is an isometric view of a lower hand guard.
Figure 7:
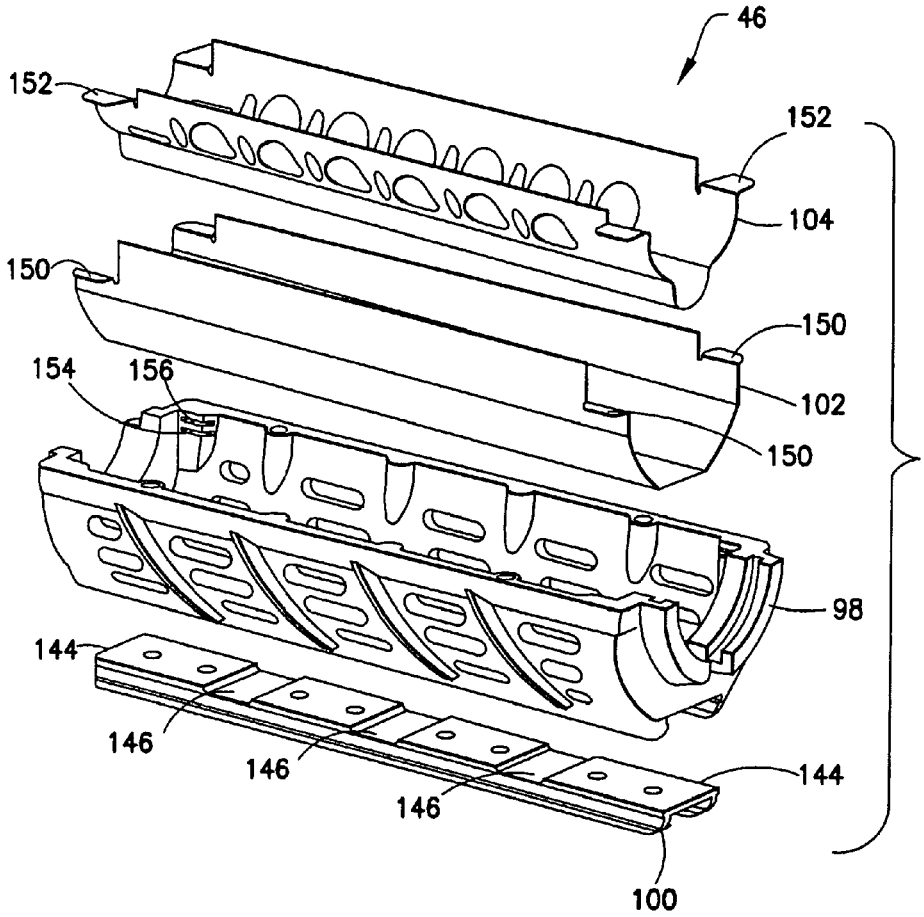
FIG. 7 is an exploded isometric view of a lower hand guard.

Referring now to FIG. 6, there is shown an isometric view of a lower hand guard in accordance with the exemplary embodiment. Referring also to FIG. 7, there is shown an exploded isometric view of a lower hand guard. Lower hand guard portion 46 may mate to the upper hand guard section 44 as well as to any other hand guard sections capable of being mated to the rifle such as conventional hand guard sections for the black rifle as noted before. The mounting system 46M (of interlocking) holes and pins accepts the complementing mounting pins of hand guard 44 or other hand guard sections for the black rifle. It is noted that though, the upper and lower hand guards are illustrated in respectively upper and lower positions the hand guards may be mounted with guard 46 upper and guard 42 lower. Lower hand guard 46 has a lower guard body portion 98 and mounting rail 100 that may be metal such as aluminum or other suitable metal, or non-metal such as plastic, ceramic, or composite material) embedded in the bottom of lower guard portion 98. In alternate embodiments, rail portion 100 may be mounted in any suitable location. Rail portion 100 in the exemplary embodiment shown has what may be referred to as a generally T-shaped feature 144 and slots 146 that may positively locate rail 100 when being embedded during molding into polymer section 98. Here, the molded polymer covers the interlocking grooves for and interlocks between the mounting rail 100 and the molded polymer providing a shearing cross section. Rail 100 may be molded into the hand guard in a manner similar to rail 62 where, rail 100 is provided for mounting accessory rails or otherwise. Here, rail 100 allows accessory rails to be selectable where the user may access rails of different heights and mount different height rails on rail 100 (see for example FIG. 1). For example, one accessory rail may be provided higher for an illumination light or other desired accessory such as a sighting device and one provided lower for some other accessory. As a further example, a mountable pistol grip may be applied directly to embedded rail 100 without an intermediate piccatiny rail. In this manner, different selectable accessories and accessory rails mountable on MT6 rail may be provided where rail 100 comprises an MT6 rail. The heat shields have tabs 150, 152 that mate with corresponding slots 154, 156 molded in portion 98. In the embodiment shown, heat shields may be used from existing guards. In alternate embodiments, guard 46 may be one piece polymer guard with an integral formed polymer mount instead providing insert 100. In alternate embodiments, any suitable combination of materials may be provided, for example, where rail 100 comprises a T-track with a multi composite guard with the guard body being one polymer and the T-track rail other polymer and with a piccatiny Rail mounted to the embedded rail.

Figure 8A:
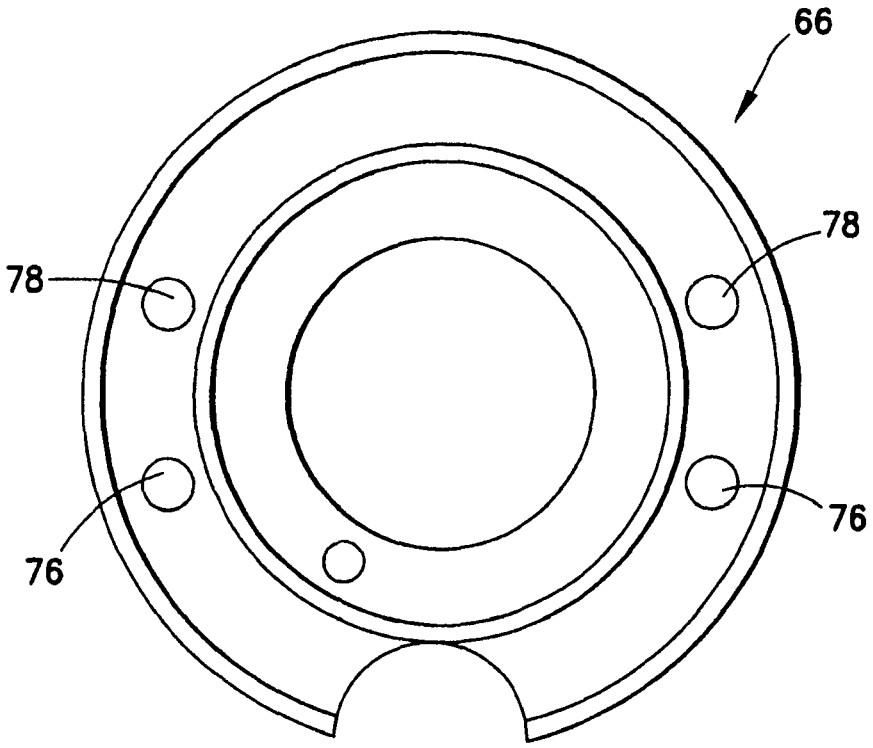
FIG. 8A is an end view of an end cap.
Figure 8B:
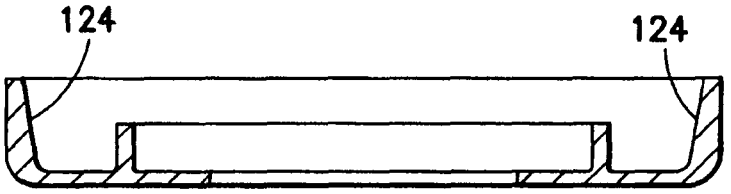
FIG. 8B is a section view of an end cap.

Referring now to FIG. 8A, there is shown an end view of an end cap. Referring also to FIG. 8B, there is shown a section view of an end cap. Cap 66 may be fixed on barrel 14 and interfaces with the front 68, 70 of the removable hand guard sections 44, 46. Here, the guards 44, 46 and the cap 66 have complementing conical tapered radially locating features 68, 70 that mate with conical feature 124 of cap 66 that fix the hand guards, eliminating play in the guard mount. In alternate embodiments, the guard mounting to the cap and barrel could have any other radially locating and/or fixing features engaged by longitudinal displacement of the guard. The upper 44 and lower 46 guards and cap 66 having interlocking facets, for example, in the embodiment shown, a pin 72, 74 (not shown) and hole 76, 78 system for rotational positioning. In alternate embodiments, other surfaces, for example, conical surfaces may be provided for radial fixing and/or may be added to pins and holes to simultaneously locate and lock the hand guards in position both in both axial, radial and rotational direction.

Figure 9:
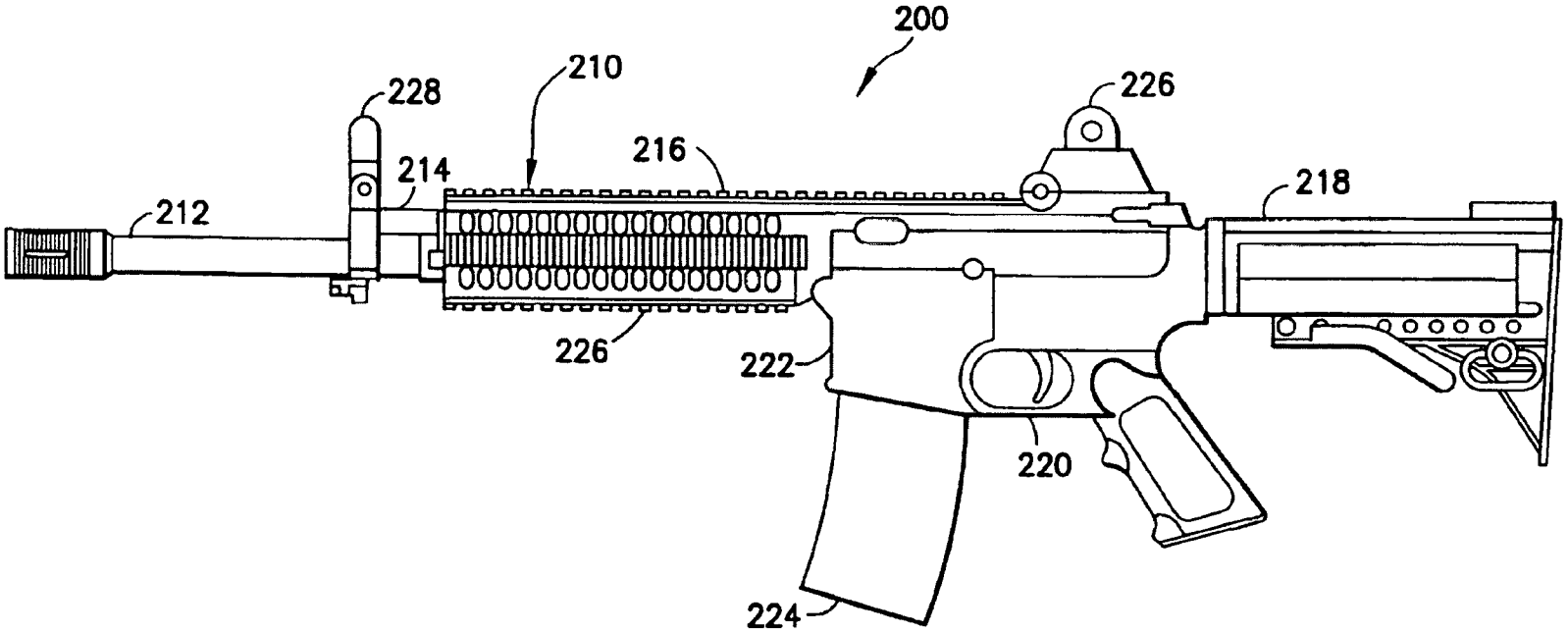
FIG. 9 is a side elevation view of a firearm.
Figure 10:
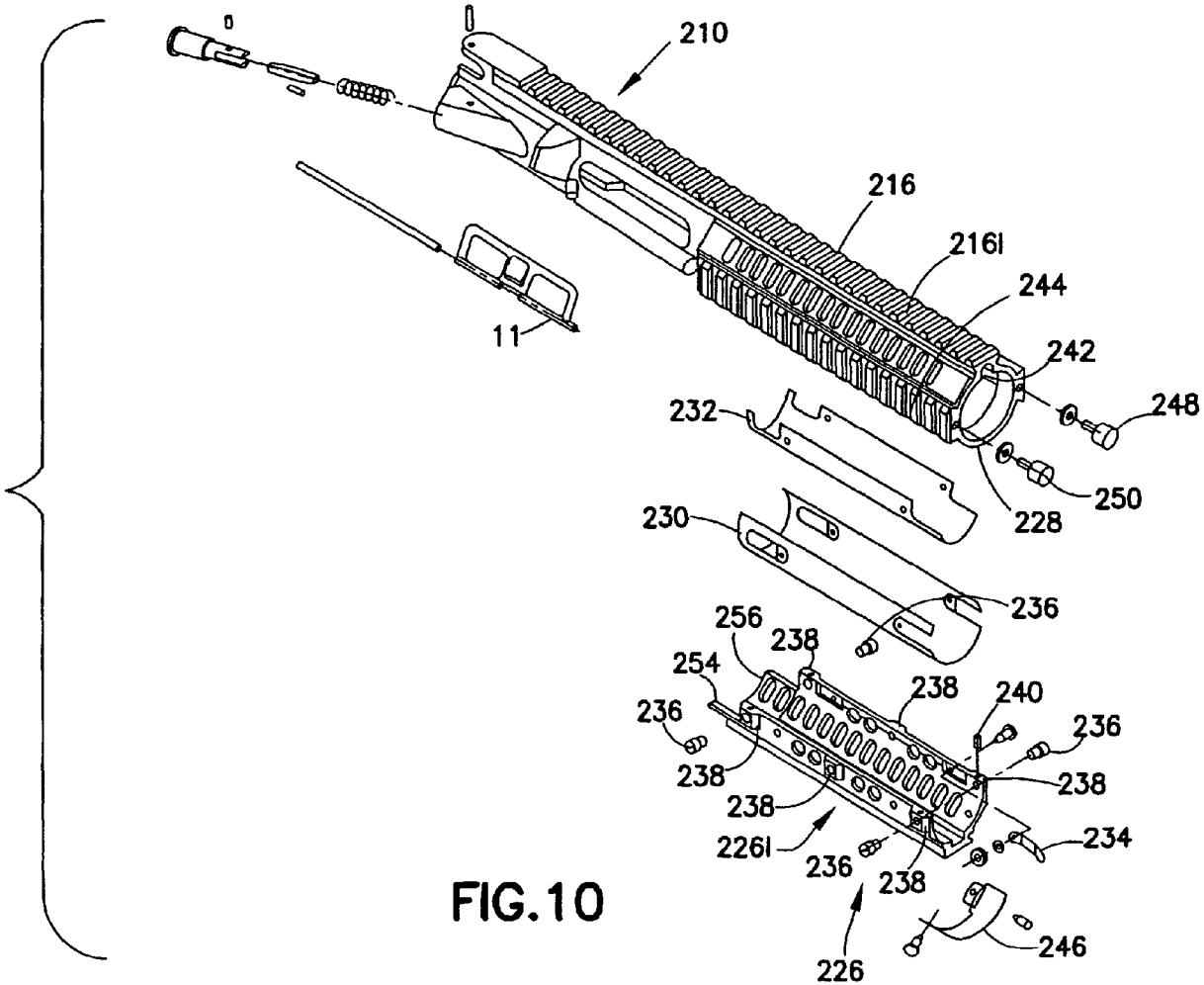
FIG. 10 is an exploded isometric view of a unitary construction upper receiver.

Referring now to FIG. 9, there is shown, a side elevation view of an automatic firearm 200 capable of automatic or semiautomatic fire incorporating features in accordance with an exemplary embodiment of the present invention. The firearm 200 and its sections described in greater detail below is merely exemplary. In alternate embodiments the firearm 200 may have other sections, portions or systems. Firearm 200 may have an upper receiver section 210 a barrel 212, gas tube 214, and hand guard 216. In alternate embodiments, the firearm may have an indirect gas operating system or gas piston system. Firearm 200 may incorporate stock 218, lower receiver section 220, magazine well 222, clip or magazine 224 and rear and front sights 226, 228. As will be described below, upper receiver 210 having barrel 212, lower receiver 220 and magazine well 222 may be modular and configurable such that firearm 200 may comprise a modular rifle design. Referring also to FIG. 10, there is shown an exploded isometric view of the unitary construction upper receiver 210 with integral hand guard section 2161 of the firearm shown in FIG. 9. In the exemplary embodiment shown in FIG. 10, upper receiver 210 may be of one-piece, or unitary construction incorporating integral hand guard section 2161 having integral rails for example at the three, nine and twelve o'clock positions relative to the barrel axis. In alternate embodiments, the rails may be positioned as desired. Hand guard 216 has a removable bottom portion 226 with integral lower rail 2261 for different mounting options that may be provided. In this embodiment the rail 2261 may be located at the six (6) o'clock position relative to the barrel axis, though in alternate embodiments the removable rail may be located in any other desired location. Lower hand guard section 226 may have features similar to guard sections 44, 46 previously described. Lower hand guard section 226 has rail portion 2261 made from aluminum or any suitable material. As previously described, rail portion 2261 may be directly embedded into the polymer used to mold body portions 254, 256, where rail portion 2261 is placed into the mold when forming the hand guard section 226. For example, extensions having binding features such as slots may be provided on rail 2261 to allow sufficient structural integrity of the molded assembly. Rail 2261 may operate to splice polymer sections 254, 256 together. In alternate embodiments, polymer sections 254, 256 may be unitary where rail 2261 is embedded within the unitary polymer section. The bottom portion 226 may be removable to install other accessories with a differently configured bottom portion, such a grenade launcher as an example. The removable bottom portion having an integral rail is mounted using a keyed/key way system or tongue and groove system or other suitable system, such as described in U.S. patent application No. 60/772,494, filed Feb. 9, 2006 which is hereby incorporated by reference in its entirety. In the exemplary embodiment shown in FIG. 10, support ring 228 may be provided at the front of the receiver for strength and attachment purposes. Hand guard 216 (formed for example by the joined upper and lower sections 2161, 226) has vent holes, integral external rails, heat shields 230, 232 or double heat shields and liners (not shown) to facilitate cooling of the barrel while keeping hand guard 216 at a temperature sufficiently low for an operator to hold. As noted before in this embodiment, the upper receiver 210 and hand guard 2161 are shown be integrally formed as a single member of unitary construction, the one piece hand guard and upper receiver unit may be formed of any suitable metal, such as steel or Al alloy, or may be formed from non-metallic material such as plastic or composites. Rails are provided on Hand guard 216 and may be integrally molded. Hence, the "Piccatiny rails", hand guard and upper receiver may be integral as a one piece member of unitary construction. In alternate embodiments the rails may be removably mounted. Hand guard 216 allows attachment of a removable bottom portion 226 with lower rail 226R for different mounting options that may be provided. The removable bottom portion 226 with rail 226R may be mounted using a keyed/key way system or tongue and groove system. A heat shield may be secured to the upper portion using any suitable attachment means such as screws, pins, rivets. The bottom portion has spring loaded movable detents that lock the bottom portion 226 to the upper portion 216. Accordingly, the bottom portion may be removably attached to the upper hand guard 2161 with spring loaded locks that facilitate ease of removal and reattachment of the bottom and upper hand guard portions. In the exemplary embodiment, spring tabs 234 (only 1 of 4 shown) are fastened to bottom portion 216 to bias detents 236 outward to protrude past the outer portion of key 238. Pin 240 (1 of 4 shown) engages a cammed recess in detent 236 such that when detent 236 is rotated, detent 236 moves against the spring tabs until flush with the outer portion of key 238. Each of keys 238 engages a mating recess or key way 242 (one shown in FIG. 10) in the upper portion of hand guard 216. Detents 236 engage mating holes 244 in the upper portion of hand guard 216 such that the lower portion 226 may be snapped into the upper portion of hand guard 216 and be positively located and coupled. Removal is accomplished by pressing in detents 236 (in the case where there are no camming surfaces and the detents 236 are simply retained) or rotating detents 236 to allow lower portion 226 to be separated from the upper portion of hand guard 2161. In alternate embodiments, other mating and locking features could be provided to couple lower portion 226 to upper portion 2161. Stop 246 may be provided and fastened to guard 226 to butt against support ring 228. As shown, support ring 228 may be provided at the front of the receiver assembly 210 for attachment purposes. Support ring 210 of the upper portion of the hand guard 2161 provides a more stable assembly to facilitate manufacture as well as provides a section for the attachment of additional alternate attachments such as by using mounting features 248, 250 to couple attachments, such as a shoulder strap to ring 228.

It should be understood that the foregoing description is only illustrative of the invention. Various alternatives and modifications can be devised by those skilled in the art without departing from the invention. Accordingly, the present invention is intended to embrace all such alternatives, modifications and variances.

What is claimed is:

1. A method of making a hand guard for a semi-automatic or automatic rifle, comprising:

forming a first portion of the hand guard from a first material;

inserting the formed first portion into a mold; and molding a second portion of the hand guard about the first portion, the second portion being a second material, the second material being different from the first material, wherein a first section of the first portion is completely encased by the second portion and a second section of the first portion is not encased by the second portion wherein the first section of the first portion is a pair of mounting flanges extending along opposite edges of the second section.

2. The method as in claim 1, wherein the second section of the first portion is a mounting rail.

3. The method as in claim 2, wherein the first material is aluminum, and wherein the second material is a polymer.

4. The method as in claim 3, wherein the polymer is a peek polymer.

5. The method as in claim 4, wherein the second section of the first portion is a mounting rail.

6. The method as in claim 1, wherein the hand guard is configured to be removably secured to the semi-automatic or automatic rifle.

7. The method as in claim 6, wherein the hand guard further comprises a removable heat shield.

8. The method as in claim 6, wherein the hand guard is configured as a lower hand guard.

9. The method as in claim 8, wherein the removable hand guard further comprises an integrally molded pistol grip.

10. The method as in claim 6, wherein the hand guard is configured as an upper hand guard.

11. A hand guard formed by the method of claim 1.

12. The method as in claim 1, wherein the hand guard further comprises: a locating feature adapted to engage a hand guard capture of the rifle and locate the hand guard relative to the hand guard capture.

13. The method as in claim 1, wherein the first material is aluminum, and wherein the second material is a polymer.

14. The method as in claim 13, wherein the polymer is a peek polymer.

15. A method of making hand guard for a semi-automatic or automatic rifle, comprising:

forming a first portion of the hand guard from a first material;

inserting the formed first portion into a mold; and molding a second portion of the hand guard about the first portion, the second portion being a second material, the second material being different from the first material, wherein a first section of the first portion is completely encased by the second portion and a second section of the first portion is not encased by the second portion, wherein the second section of the first portion is a mounting rail and wherein the first section of the first portion is a pair of mounting flanges extending along opposite edges of the second section.

16. The method as in claim 15, wherein the hand guard is configured to be removably secured to the semi-automatic or automatic rifle.

17. A method of providing a removable hand guard for a rifle, comprising:

providing an upper receiver of a rifle;

removably securing the hand guard to the receiver, wherein the hand guard is formed by:

forming a first portion of the hand guard from a first material;

inserting the formed first portion into a mold; and molding a second portion of the hand guard about the first portion, the second portion being a second material, the second material being different from the first material, wherein a first section of the first portion is completely encased by the second portion and a second section of the first portion is not encased by the second portion, wherein the first section of the first portion is a pair of mounting flanges extending along opposite edges of the second section.

18. The method as in claim 17, wherein the second section of the first portion is a mounting rail and wherein the first material is aluminum, and wherein the second material is a polymer.

19. A rifle formed by the method of claim 18.

* * * * *